US006350218B1

(12) United States Patent
Dalebout et al.

(10) Patent No.: US 6,350,218 B1
(45) Date of Patent: Feb. 26, 2002

(54) FOLD-OUT TREADMILL

(75) Inventors: William T. Dalebout, Logan; Rodney Hammer, Lewiston; Rick Hendrickson, Logan, all of UT (US)

(73) Assignee: Icon Health & Fitness, Inc., Logan, UT (US)

( * ) Notice: Subject to any disclaimer, the term of this patent is extended or adjusted under 35 U.S.C. 154(b) by 0 days.

(21) Appl. No.: 09/470,605

(22) Filed: Dec. 22, 1999

Related U.S. Application Data

(60) Continuation-in-part of application No. 09/231,208, filed on Jan. 14, 1999, now Pat. No. 6,033,347, which is a division of application No. 08/959,237, filed on Oct. 28, 1997, now Pat. No. 5,899,834.

(51) Int. Cl.[7] ..... A63B 22/00

(52) U.S. Cl. ..... 482/54; 482/51

(58) Field of Search ..... 482/51, 54

(56) References Cited

U.S. PATENT DOCUMENTS

| | | | |
|---|---|---|---|
| 321,388 | A | 6/1885 | Ruebsam |
| 663,486 | A | 12/1900 | Boren |
| 881,521 | A | 3/1908 | Wilson |
| 931,394 | A | 8/1909 | Day |
| 1,020,777 | A | 3/1912 | Peterson |

(List continued on next page.)

FOREIGN PATENT DOCUMENTS

| | | |
|---|---|---|
| DE | 83466 | 8/1908 |
| GB | 1169148 | 10/1969 |
| GB | 1 326 263 | 8/1973 |
| JP | 56-56358 | 5/1981 |
| JP | 56-150562 | 11/1981 |

OTHER PUBLICATIONS

Copy of Brochure Entitled "*Technology for Total Fitness Genesis 2000*," 6 pages—copyright 1985.
Copy of Brochure Entitled "*Technology for Total Fitness Genesis 3000*." 7 pages—copyright 1985.

*Primary Examiner*—Glenn E. Richman
(74) *Attorney, Agent, or Firm*—Workman, Nydegger & Seeley

(57) ABSTRACT

A fold-out treadmill includes a deck having a rear end that is attached to a stationary base. The deck has a front end, a rear end, and a continuous belt rotatably mounted thereon. The rear end of the deck is moveably attached to the base so as to enable the deck to be selectively rotated between an operational position in which the deck is positioned for operation by a user positioned thereon and a storage position in which the deck is positioned proximate to the handrail. The treadmill also includes a collapsible handrail that has a rear end attached to the deck and an opposing front end projecting above the front end of the deck when the deck is in the operational position. The handrail is configured such that when the deck is moved between the operational position and the storage position the handrail does not extend beyond the rear end of the base. The treadmill also includes a fold-out assembly movably connecting the rear end of the handrail to the deck so as to enable the front end of the handrail to project above the front end of the deck when the deck is in the operational position and to automatically collapse into a compact storage configuration when the deck is rotated into the storage position. The fold-out assembly is configured such that the handrail is repositioned by a combination of pivotal movement and linear translation relative to the deck as the deck is selectively rotated from the storage position into the operational position. The fold-out assembly comprises a leg and a slider assembly. The slider assembly is connected to the rear end of the handrail and is configured to allow linear translation of the handrail relative to the deck when the deck is selectively rotated between the storage position and the operational position.

23 Claims, 7 Drawing Sheets

U.S. PATENT DOCUMENTS 1,715,870 A 6/1929 Spain
1,850,530 A 3/1932 Brown
1,902,694 A 3/1933 Edwards
1,928,089 A 9/1933 Blickman
1,973,945 A 9/1934 Chavin et al.
2,855,200 A 10/1958 Blickman
3,127,171 A 3/1964 Noland et al.
D207,541 S 5/1967 Hesen
3,378,259 A 4/1968 Kupchinski
D211,801 S 7/1968 Quinton
3,586,322 A 6/1971 Kverneland
3,589,715 A 6/1971 Mark et al.
3,614,097 A 10/1971 Blickman
3,642,279 A 2/1972 Cutter
3,650,529 A * 3/1972 Salm et al. ..... 482/54
3,659,845 A 5/1972 Quinton
3,731,917 A * 5/1973 Townsend ..... 482/54
3,741,538 A 6/1973 Lewis et al.
3,874,657 A 4/1975 Niebojewski
3,918,710 A 11/1975 Niebojewski
4,026,545 A 5/1977 Schonenberg
4,066,257 A 1/1978 Moller
4,248,476 A 2/1981 Phelps
4,300,761 A 11/1981 Howard
4,383,714 A 5/1983 Ishida
4,422,635 A 12/1983 Herod et al.
4,625,962 A 12/1986 Street
4,664,646 A 5/1987 Rorabaugh
4,679,787 A * 7/1987 Guilbault ..... 482/54
4,757,987 A 7/1988 Allemand
4,776,582 A 10/1988 Ramhorst
4,805,901 A 2/1989 Kulick
4,826,153 A 5/1989 Schalip
4,905,330 A 3/1990 Jacobs
4,913,396 A 4/1990 Dalebout et al.
4,913,423 A 4/1990 Farran et al.
4,921,247 A 5/1990 Sterling
4,974,831 A 12/1990 Dunham
4,998,725 A 3/1991 Watterson et al.
5,002,271 A 3/1991 Gonzales
5,029,801 A 7/1991 Dalebout et al.
5,058,881 A 10/1991 Meason
5,102,380 A 4/1992 Jacobson et al.
5,109,778 A 5/1992 Berkowitz
5,110,117 A 5/1992 Fisher et al.
5,163,885 A 11/1992 Wanzer et al.
5,184,988 A 2/1993 Dunham
5,192,255 A 3/1993 Dalebout et al.
5,207,622 A 5/1993 Wilkinson et al.
5,207,628 A 5/1993 Graham
5,282,776 A 2/1994 Dalebout
5,299,992 A 4/1994 Wilkinson
5,352,167 A 10/1994 Ulicny
5,372,559 A 12/1994 Dalebout et al.
5,385,519 A 1/1995 Hsu et al.
5,429,563 A 7/1995 Engel et al.
5,441,467 A 8/1995 Stevens
5,518,471 A 5/1996 Hettinger et al.
5,746,682 A 5/1998 Hung
5,868,648 A * 2/1999 Coody et al. ..... 482/54

* cited by examiner

FOLD-OUT TREADMILL

RELATED APPLICATIONS

This patent application is a continuation-in-part of U.S. patent application Ser. No. 09/231,208, filed on Jan. 14, 1999, U.S. Pat. No. 6,033,347 in the names of William T. Dalebout, Rodney Hammer, and Rick Hendrickson, and entitled "Fold-out Treadmill," which is a divisional of Ser. No. 08/959,237, filed Oct. 28, 1997, now, U.S. Pat. No. 5,899,834, issued on May 4, 1999, to William T. Dalebout, Rodney Hammer, and Rick Hendrickson, and entitled "Fold-out Treadmill".

THE FIELD OF THE INVENTION

The present invention relates to treadmills, and in particular to foldable treadmills.

THE RELEVANT TECHNOLOGY

Treadmills are popular exercise machines that enable a user to engage in a running or walking movement while maintaining a relatively stationary position. A conventional treadmill includes two major sections: a base and a handrail. The base includes a frame having rollers mounted on opposing ends thereof. A continuous belt extends around and between the two rollers so as to be fashioned into a flat, continuous loop. In one design, an electrical motor is connected to the front roller. When the motor is turned on, the roller spins which imparts rotational movement to the belt. In an alternative design, no motor is provided. The continuous belt is rotated by the user standing on the belt and walking or running thereon. Friction between. the user and the belt cause the belt to rotate in a continuous loop around the rollers.

The handrail acts as a support or stabilizer for the user. Conventional handrails project from the frame toward and across the front of the treadmill. Some alternative treadmills include moveable arms attached to the handrail. The movable arms enable the user to exercise their arms while running or walking on the treadmill.

A control console can also be mounted on the handrail. The control console is used control the operation of the treadmill and to display related information such as elapsed time, speed, pulse, or calories burned. Controls for treadmill speed, inclination, or exercise program may also be part of the control console.

To use the treadmill, a user steps onto the continuous belt facing the front of the treadmill. The electric motor is then turned on causing the top surface of the belt to rotate from the front of the base to the rear of the base. To maintain a stationary position on the treadmill, the user must then walk or run at a speed corresponding to the speed of the belt. If desired, the user can grasp the handrail for support. When the user is done exercising, he or she simply turns the treadmill off and steps off the continuous belt.

Early treadmills tended to be bulky due to large motors and oversized parts. Such treadmills were difficult to move around and took up relatively large amounts of space. Accordingly, these early treadmills were almost exclusively found in spas and gyms having large amounts of floor space. As engineering improved, the size and weight of treadmills decreased. Nevertheless, the size of treadmills was limited by the length and width of the base which had to be large enough for a user to safely walk or run thereon. Due to this minimum size limitation, treadmills were significantly precluded from home or apartment use which did not have available space to house a treadmill.

In an attempt to remedy this problem, foldable treadmills were developed. Foldable treadmills include a base having rollers and a continuous belt as previously described. The front of the base, however, is hingedly attached to a stationary stand. Upstanding from the stationary stand is a handrail. The base can be selectively moved between an operational and storage position. In the operation position, the base is positioned for use by a user and is substantially parallel with the support surface. Many treadmills do, however, have the ability to change the position of the base relative to the support surface to simulate walking uphill. To use the treadmill, the user stands on the base facing the stationary stand and walks or runs thereon as discussed above. When use is completed, the base can be selectively moved to a storage position by lifting up the rear end of the base. The base is lifted to the storage position where it is in a substantially upright position with the front end of the base still rotatably connected to the stationary stand. By folding up the base, the treadmill takes up substantially less floor space making the treadmill more accessible for use in homes and apartments.

While foldable treadmills take up less space, they still have other drawbacks. For example, to minimize obstruction by the treadmill, it is desirable for the treadmill to be folded up against a wall, when not in use. The stationary stand must be positioned proximate to the wall to enable the base to fold out. With the treadmill positioned so that the stationary stand is closest to the wall a user is forced to face the wall during use of the treadmill. The user, however, typically prefers to look into the room, such as toward a television or other people, during use.

To enable a user to face into a room during use of a conventional foldable treadmill, the user must first rotate the stationary stand away from the wall, and then move the treadmill sufficiently far away from the wall so that the base does not hit the wall when the base is lowered into the operational position. When use is completed, the user must fold up the treadmill and move it back to the wall for storage. This required moving of the treadmill for each use is time consuming, annoying, and awkward. Further, treadmills are typically heavy and fairly large, making them physically difficult to move. Even those treadmills that are "portable" require a great deal of effort to move and reposition so that the user can face away from the wall. As a result, the frequency of use of the treadmill is decreased, thereby partially defeating the purpose of the treadmill.

OBJECTS AND BRIEF SUMMARY OF THE INVENTION

It is, therefore, an object of the present invention to provide improved foldable treadmills that can be folded up for storage against a wall.

Another object of the present invention is to provide foldable treadmills which can be unfolded from storage against a wall for use without contacting the wall and without additional movement of the treadmill.

Yet another object of the present invention is to provide treadmills as above wherein the user is facing into the room and away from the wall during use of the treadmill when the treadmill, without further movement, is unfolded from storage against a wall.

Finally, another object of the present invention is to provide treadmills as above in which the deck and correspondingly the handrail move between the operational position and the storage position entirely within the footprint of the treadmill.

Additional objects and advantages of the invention will be set forth in the description which follows, and will be obvious from the description, or may be learned by the practice of the invention. The objects and advantages of the invention may be realized and obtained by means of the instruments and combinations particularly pointed out in the appended claims, or may be learned by the practice of the invention as set forth hereinafter.

To achieve the foregoing objects, and in accordance with the invention as embodied and broadly described herein, a foldable or fold-out treadmill is provided. The treadmill comprises a handrail and a support structure that includes a deck and a stationary base. The base has a rear end and an opposing front end. The deck has a front end, a rear end, and a continuous belt rotatably mounted thereon. The rear end of the deck is moveably attached to the base so as to enable the deck to be selectively rotated between an operational position in which the deck is positioned for operation by a user positioned thereon and a storage position in which the deck is positioned proximate to the handrail.

The treadmill also includes a collapsible handrail attached to the support structure. The handrail has a rear end attached to the deck and an opposing front end projecting above the front end of the deck when the deck is in the operational position. The handrail is further configured such that when the deck is moved between the operational position and the storage position the handrail does not extend beyond the rear end of the base.

The treadmill also includes a fold-out assembly that movably connects the rear end of the handrail to the support structure so as to enable the front end of the handrail to project above the front end of the deck when the deck is in the operational position and to collapse into a compact storage configuration when the deck is rotated into the storage position. The fold-out assembly is configured such that the handrail is repositioned by a combination of pivotal movement and linear translation relative to the deck as the deck is selectively rotated from the storage position into the operational position. In one embodiment, the fold-out assembly comprises a leg and a slider assembly. The leg has a proximal end rotatably attached to the rear end of the handrail and a distal end rotatably connected to the base. The proximal end of the leg and the rear end of the handrail are movably attached to the deck to allow the handrail to automatically collapse into a compact storage configuration when the deck is rotated from the operational position into the storage position by a combination of rotational movement and linear translation relative to the deck.

The slider assembly is connected to the rear end of the handrail and is configured to allow the linear translation of the handrail relative to the deck when the deck is selectively rotated between the storage position and the operational position. In one embodiment, the slider assembly comprises slider rods and a slider. The slider rods are attached to the deck. The slider is connected to the rear end of the handrail and is configured to cooperate with the slider rods to allow the handrail to translate linearly relative to the deck so as to make the handrail automatically collapse into a compact configuration when the deck is rotated into the storage position.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not, therefore, to be considered to be limiting of its scope, the invention will be described and explained with additional specificity and detail through the use of the accompanying drawings in which.

DETAILED DESCRIPTION OF THE PREFERRED EMBODIMENT

Figure 1:
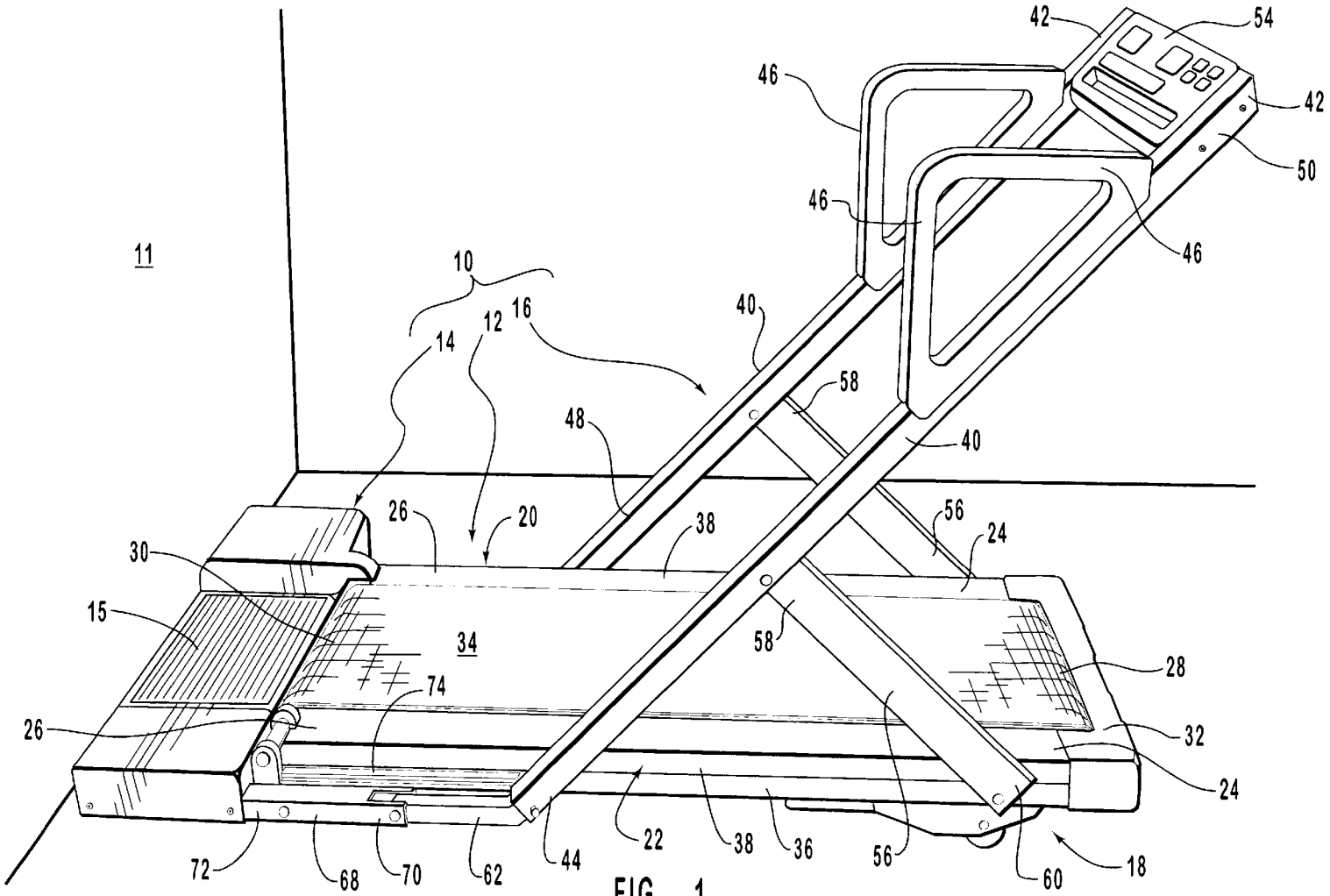
FIG. 1 is a perspective view of one embodiment of the fold-out treadmill in an operational position.

The present invention relates to treadmills that are selectively foldable and enable a user to face into a room while exercising on the treadmill that is positioned substantially against a wall. Depicted in FIG. 1 is one embodiment of a treadmill incorporating the features of the present invention. Treadmill 10 includes a deck 12 and a handrail 16 Deck 12 is moveable between an operational position, where deck 12 is substantially flat or otherwise positioned for use by a person positioned thereon, and a storage position in which deck 12 is positioned proximate to handrail 16. Handrail 16 projects above deck 12 when deck 12 is in the operational position and automatically collapses into substantial alignment with deck 12 when deck 12 is rotated into the storage position.

Figure 3:
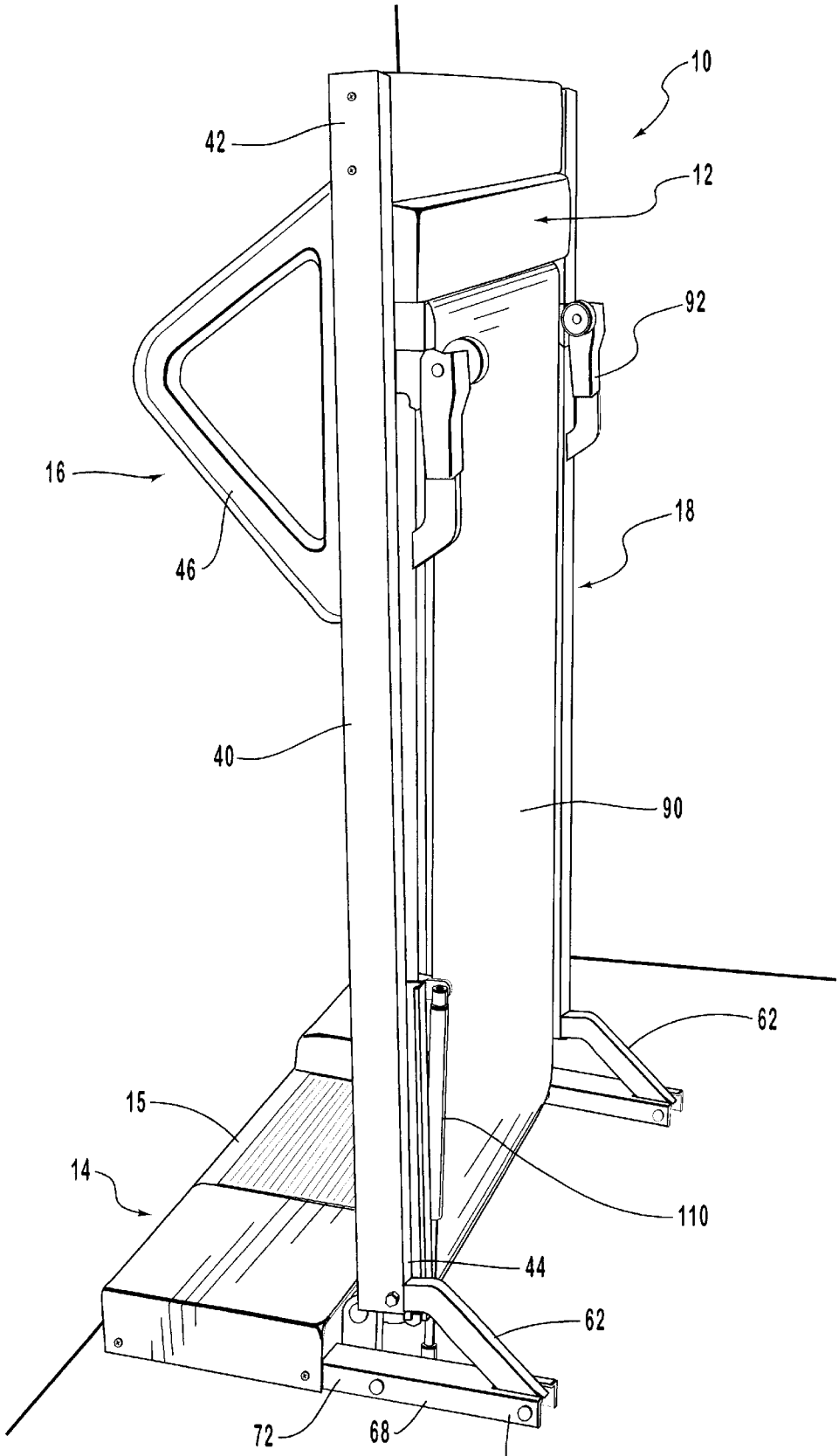
FIG. 3 is a perspective view of the fold-out treadmill shown in FIG. 1 folded into a storage position.

More specifically, fold-out treadmill 10 comprises a base 14, deck 12, and handrail 16. Deck 12 has a back end 30 and a front end 28. Back end 30 of deck 12 is hingedly mounted to base 14. Together, deck 12 and base 14 form the support structure of treadmill 10. One embodiment of treadmill 10 is illustrated in FIG. 1 with deck 12 in an operational position. In the operational position, deck 12 extends outwardly from base 14 and is positioned for use by a user positioned thereon. In the operational position, deck 12 may be substantially level or somewhat inclined depending on the user's preference. Deck 12 also has a storage position in which deck 12 is positioned proximate to handrail 16, as shown in FIG. 3. In one embodiment, when deck 12 is in the storage position, it is substantially upright. Deck 12 can be selectively rotated between the operational position and the storage position.

Referring to FIG. 1, deck 12 comprises a frame structure 18 that includes a left frame member 20 and a right frame member 22. Left and right frame members 20 and 22, respectively, are defined when deck 12 is in the operational position and the user is facing front end 28 of deck 12. As shown in FIG. 1, left frame member 20 and right frame member 22 are generally aligned. Left frame member 20 and right frame member 22 each have a forward end 24 and a back end 26.

In one embodiment illustrated in FIG. 1, deck 12 also comprises an optional front member 32. Front end 28 of deck 12 is defined as the forward-most end of deck 12 when deck 12 is in the operational position. A user faces front end 28 of deck 12 when using treadmill 10. Conversely, back end 30 of deck 12 is defined as the rear-most end of deck 12 proximate to base 14. Back end 30 of deck 12 is rotatably connected to base 14.

An optional front member 32 is attached to forward end 24 of both left frame member 20 and right frame member 22 at front end 28 of deck 12. In one embodiment, left frame member 20, right frame member 22, and front member 32 form frame structure 18 of deck 12. Left frame member 20 and right frame member 22 are in a longitudinal, spaced apart relationship while front member 32 is a cross member that extends laterally between forward end 24 of left frame member 20 and forward end 24 of right frame member 22. Alternatively, frame structure 18 may comprise left frame member 20 and right frame member 22.

Deck 12 has a continuous or endless belt 34 mounted on deck 12. In particular, continuous belt 34 is positioned between left frame member 20 and right frame member 22. Continuous belt 34 is configured to receive a user thereon to perform exercises, including walking, running, jogging and other similar or related activities. Treadmill 10 can also be used for stationary exercises, such as stretching or bending, while the user is standing on continuous belt 34. The primary function, however, of treadmill 10 is for running, walking or jogging.

One embodiment of left frame member 20 and right frame member 22 of frame structure 18 comprises a side rail 36 and a side base 38. As illustrated in FIG. 1, side base 38 is positioned over the top of side rail 36 of both left frame member 20 and right frame member 22. Left frame member 20 is not totally visible in FIG. 1 but is a mirror image of right frame member 22. Side bases 38 of left frame member 20 and right frame member 22 are capable of supporting the weight of a user standing thereon. Side bases 38 are positioned on each side of continuous belt 34.

The position of side bases 38 of both left frame member 20 and right frame member 22 are such that a user of treadmill 10 can comfortably and easily step off of continuous belt 34 onto one or both of side bases 38. The user can also stand on side base 38 of either left frame, member 20 or right frame member 22 or both until he or she is ready to step onto continuous belt 34. In addition, side bases 38 are wide enough for the user to comfortably place his or her foot thereon. It can be appreciated that other embodiments of left frame member 20 and right frame member 22 or the components thereof are equally effective in carrying out the intended function thereof.

Treadmill 10 also comprises base 14 that is movably attached to back end 30 of deck 12. One embodiment of base 14, shown in FIG. 1, includes main body 15 and a pair of stabilizer members 68. Stabilizer members 68 have a forward end 70 and a back end 72. Back end 72 of each stabilizer member 68 is fixedly attached to main body 15 of base 14 near the periphery thereof and extends outwardly from main body 15 in a direction generally parallel with deck 12 when deck 12 is in the operational position.

Main body 15 of base 14 is positioned substantially directly behind endless belt 34 such that should the user roll backwards off of endless belt 34, he or she will land on main body 15 of base 14. Main body 15 has a low profile as will be discussed below that enables main body 15 to be slightly shorter in height than endless belt 34 when deck 12 is in the operational position. This helps to prevent the user from hitting base 14 while running or walking on treadmill 10. Base 14 is also configured to rest on a support surface with its rear end abutting, or in close proximity to, a wall.

One embodiment of treadmill 10 includes a switching mechanism on base 14 that automatically turns off motor 98 when the user is on main body 15 and, consequently, prevents a user from being trapped on main body 15 after inadvertently landing on main body 15 while treadmill 10 continues to run.

In one embodiment, back end 30 of deck 12 is rotatably attached to base 14 by conventional methods. Specifically, back end 26 of both left frame member 20 and right frame member 22 is pivotally attached to base 14, and base 14 extends laterally across back end 26 of both left frame member 20 and right frame member 22. Various other embodiments of structure capable of performing the function of a means for connecting deck 12 to base 14 so as to enable deck 12 to selectively rotate between the operational position in which deck 12 is positioned for use by a user, and a storage position in which deck 12 is proximate to handrail 16, are equally effective in performing the intended function thereof.

FIG. 1 also shows one embodiment of handrail 16 that is movably attached to base 14 and deck 12. One embodiment of handrail 16 is substantially U-shaped. When deck 12 is in the operational position handrail 16 is open at the rear-most portion and closed at the front-most portion. As shown in FIG. 1, handrail 16 extends across deck 12 at front end 28 of deck 12 when deck 12 is in the operational position. It can be appreciated that various other configurations of handrail 16 are equally effective in performing the intended function thereof.

Handrail 16 is configured to automatically collapse into substantial alignment with deck 12 when deck 12 is in the storage position, as shown in FIG. 3. As illustrated in FIG. 1, in one embodiment, handrail 16 has a first end 48 and a second end 50. First end 48 of handrail 16 is attached to base 14, and second end 50 of handrail 16 projects above front end 28 of deck 12 when deck 12 is in the operational position.

Referring again to FIG. 1, handrail 16 comprises a pair of uprights 40. For clarity, the right side of handrail 16 is described, keeping in mind that the left side thereof, is the mirror image of the right side of handrail 16. In one embodiment, uprights 40 are movably attached to base 14 and frame structure 18 of deck 12. Uprights 40 have a lower end 44 movably attached to base 14 and deck 12 and an opposing upper end 42 projecting above front end 28 of deck 12 when deck 12 is in the operational position. Lower end 44 of upright 40 is movably attached to right frame member 22 of frame structure 18. The specific attachment of upright 40 to right frame member 22 will be discussed in further detail below.

Handrail 16 also includes a pair of handles 46 that are fixedly attached to uprights 40 and extend outwardly from uprights 40 toward back end 30 of deck 12. Handle 46 is attached to each upright 40 near upper end 42 thereof. It will be appreciated that the configuration of handles 46 may vary. Handles 46 must be capable of supporting the user of treadmill 10. In addition, handles 46 must be comfortable for a user to grab or hold. Handles 46 are attached to uprights 40 by conventional methods such as screws, bolts, welds, or the like. In one embodiment illustrated in FIG. 1, handles 46 are bolted to uprights 40.

Handrail 16 may comprise an optional control console 54. Console 54 may be attached to upper end 42 of the pair of uprights 40. Control console 54 provides the user interface for monitoring and controlling operation of treadmill 10 and may have operating controls such as an actuator switch to operate treadmill 10 and indicator means which may be operated by the user to determine various parameters associated with the exercise being performed. Console 54 may also include such things as a cup or glass holder so that the user may position a liquid refreshment for use during the course of performing the exercise. It can be appreciated that various embodiments of console 54 are possible and may be so simple as to include only an on/off switch. It is contemplated that console 54 may be completely replaced by a support member.

When deck 12 is in the operational position and handrail 16 is projecting above front end 28 of deck 12, handrail 16 defines the sides of an exercise space therebetween. Handles 46 are designed and positioned such that they are near the hands of the user for easy and quick grasping should a user need handles 46 to maintain his or her balance when the user is exercising on continuous belt 34, as well as making the user feel stable and secure while using treadmill 10.

A pair of elongated supports 56 are movably attached to handrail 16 and deck 12, as shown in FIG. 1. Elongated supports 56 have a first end 58 that is movably attached to upright 40 of handrail 16 and a second end 60 that is movably attached to frame structure 18 of deck 12. As with handrail 16, the right side and left side of treadmill 10 are mirror images and for clarity, only the right side will be discussed in detail. First end 58 of elongated support 56 is pivotally attached to upright 40. Lower end 60 is pivotally attached to side rail 36 of right frame member 20. Other methods of movably attaching first end 58 to upright 40 and second end 60 to side rail 36 are equally effective in carrying out the function thereof.

Figure 2A:
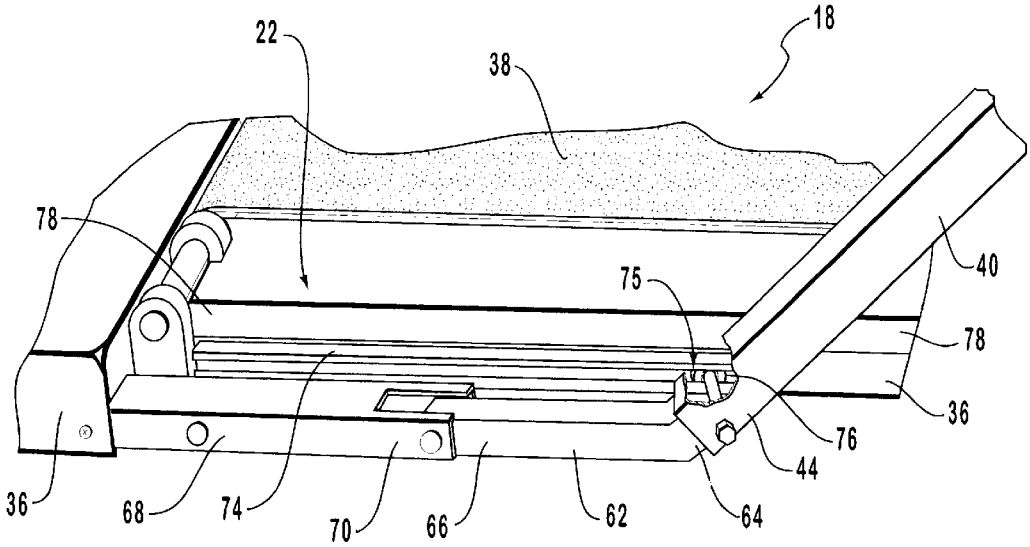
FIG. 2A is an enlarged partial, cutaway perspective view of the fold-out treadmill shown in FIG. 1.

In one embodiment of treadmill 10, lower end 44 of upright 40 of handrail 16 is movably attached to a leg 62. As shown in FIG. 2A, leg 62 has a proximal end 64 that is movably attached to lower end 44 of upright 40 and a distal end 66 that is movably attached to forward end 70 of stabilizer member 68. In the embodiment illustrated in FIG. 2A, distal end 66 of leg 62 is pivotally attached to forward end 70 of stabilizer member 68. Other methods of movably attaching distal end 66 of leg 62 to forward end 70 of stabilizer member 68 are equally effective in carrying out the intended function thereof.

Figure 2B:
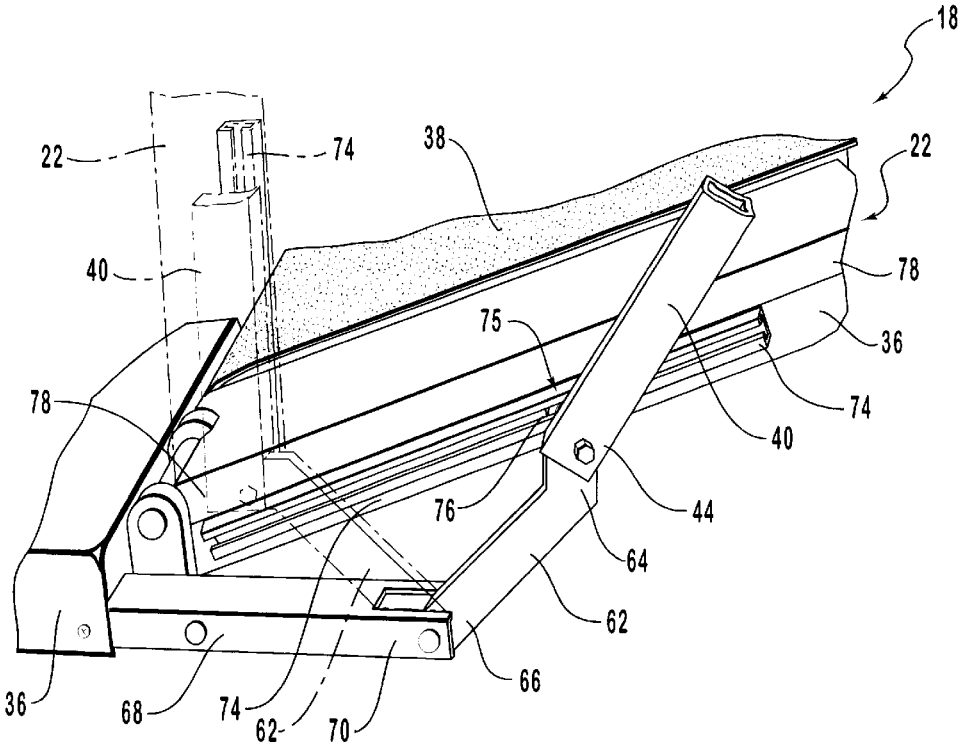
FIG. 2B is a perspective view of the structure shown in FIG. 2A collapsed into a storage position.

Treadmill 10 also has a slider assembly 75 that comprises an elongated slider bracket 74 and a wheel 76. Elongated slider bracket 74 is fixedly attached to the exposed outside surface 78 of both left frame member 20 and right frame member 22. Slider bracket 74 is attached to side rail 36. Slider bracket 74 is capable of receiving wheel 76 rotatably attached to handrail 16 and allowing linear translation of lower end 44 of upright 40 of handrail 16 relative to deck 12. Wheel 76 is configured to cooperate with slider bracket 74 and is disposed therein. Wheel 76 is movably attached to the inside of upright 40 of handrail 16 proximate to deck 12 near or at the point of attachment between lower end 44 of upright 40 and proximate end 64 of leg 62. Elongated slider bracket 74 and wheel 76 illustrated in FIGS. 2A and 2B are one embodiment of structure capable of preforming the function of a slider means for allowing linear translation of handrail 16 relative to deck 12.

Elongated supports 56, legs 62, and slider means are one embodiment of structure capable of performing the function of a fold-out means for connecting handrail 16 to deck 12 so as to enable handrail 16 to project above deck 12 when deck 12 is in the operational position and to automatically collapse into substantial alignment with deck 12 when deck 12 is rotated into the storage position. Fold-out means enables deck 12 to be repositioned by pivotal movement from the storage position into the operational position, and simultaneously, handrail 16 to be repositioned by a combination of pivotal movement and linear translation. FIGS. 2A and 2B illustrate the pivotal movement and linear translation allowed by fold-out means when deck 12 is pivoting between the operational position and the storage position, while simultaneously handrail 16 pivots and linearly translates automatically in response to the movement by deck 12.

When treadmill 10 is being repositioned, deck 12 and handrail 16 unfold outwardly so as to allow a user on deck 12 to be facing front end 28 of deck 12 as illustrated in FIG. 1. In those cases that treadmill 10 is selectively stored against a wall 11, deck 12 and handrail 16 unfold outwardly from wall 11 so that a user is both lacing away from wall 11 and toward front end 28 of deck 12. It can be appreciated that various embodiments of structure capable of performing the function of such a fold-out means are equally effective in carrying out the intended function thereof.

FIG. 3 illustrates deck 12 in the storage position where handrail 16 has automatically collapsed into substantial alignment with deck 12. In the storage position, deck 12 is positioned proximate to handrail 16. In one embodiment, deck 12 is in the storage position, and deck 12 and handrail 16 are substantially upright. In this configuration, treadmill 10 is significantly more compact and occupies less floor space. When deck 12 is in the storage position, treadmill 10 is supported by base 14. Base 14 comprises body 15 and stabilizer members 68 and is configured to be freestanding. Base 14 stably supports treadmill 10 when deck 12 is in the storage position and during movement between the storage position and operational position.

While the drawings and foregoing description disclose one presently preferred embodiment, it should be appreciated that other handrail configurations may be readily adapted for use with the present invention. For example, instead of handrail 16 folding and unfolding in a single motion as deck 12 is moved between the operational and storage positions, other more simplified handrail configurations can readily be employed wherein deck 12 is rotated between the storage and operational positions in one motion and, then in a second and separate motion, handrail 16 and control console 54 are rotated between their compact storage and their operational positions.

As illustrated in FIG. 3, deck 12 may include a rigid undercover 90 secured to frame structure 18. The rigid undercover 90 maybe formed of plastic-like material to create an essentially rigid underside to deck 12. Although undercover 90 is rigid, undercover 90 may be of material thin enough to be flexible or to deflect without breaking. Without rigid undercover 90, deck 12 has exposed operating structure, such as electrical components, and any inclination system is exposed. Aside from an undesirable visual appearance, the exposed components can be hazardous because of having sharp edges, points and structures against which things or items may bump or snag. Similarly, there is a risk of exposing any electrical components to moisture as well as exposing the user to an electrical shock hazard if the treadmill is inadvertently not turned off. It may also be noted that undercover 90 may be formed to cover only a portion of the exposed components or may be formed into multiple or removable sections to facilitate any needed repair.

As depicted in FIG. 3, one embodiment of deck 12 includes a pair of feet 92 which are rotatably secured to each side of the frame structure 18. Specifically, feet 92 are pivotally secured to right frame member 22 and frame member 20. Other conventional methods of movably attaching feet 92 are equally effective in carrying out the intended function thereof.

Deck 12 may include a mechanism for automatically varying the inclination of deck 12 relative to the support surface. A motor connected to a rack and a pinion which is connected to feet 92 may be used to vary the inclination of deck 12. Rotatable feet 92 and a mechanism for automatically varying the inclination are one example of structure capable of performing the function of an incline means for varying the inclination of deck 12 relative to the underlying support surface. It is contemplated that various types of known inclination means may be incorporated within deck 12. Other types of inclination means are equally effective in carrying out the intended function thereof.

Figure 4:
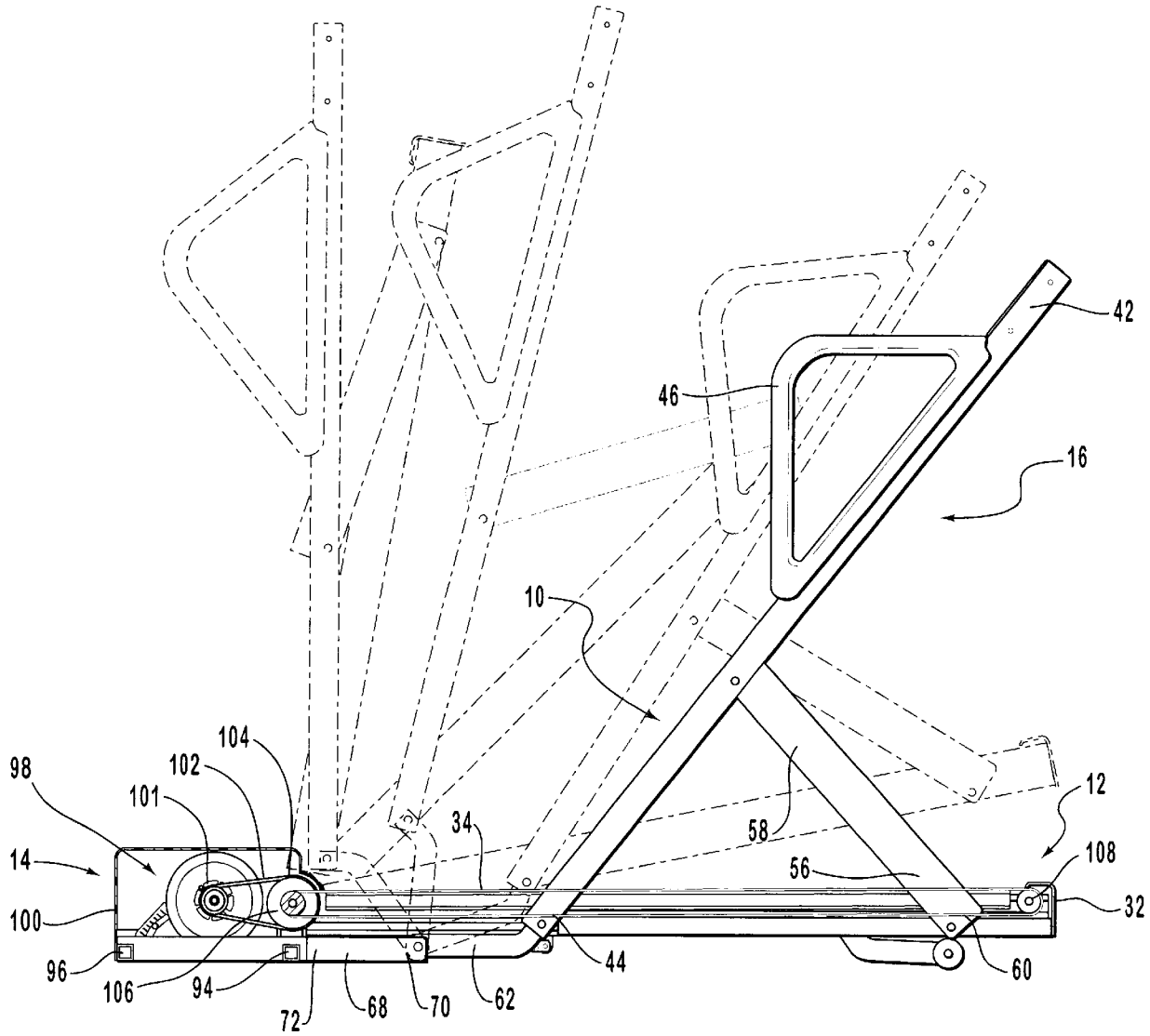
FIG. 4 is a partial cross-sectional, elevation side view of the fold-out treadmill shown in FIG. 1 in the operational position, and illustrates the gradual changes in position that are shown in phantom as the treadmill moves from the operational position to the storage position.

As illustrated in FIG. 4, base 14 has a cover 100 positioned over structure such as a drive means for supplying power to deck 12 to drive continuous belt 34. Cover 100 provides a place for the user of treadmill 10 to stand prior to getting on continuous belt 34 or when stepping off of continuous belt 34 as well as for aesthetics and safety reasons to minimize the risk of materials entering the drive mechanism or otherwise interfering with the operation and mechanism.

Base 14 also comprises a forward cross-support 94 which is disposed between stabilizer members 68. Similarly, base 14 includes a rear cross-support 96 that extends between and is connected to the back-most part of body 15 of base 14. Forward and rear cross-supports 94 and 96, respectively, may be attached to body 15 of base 14 by conventional attachment methods such as by nuts and bolts, brackets, welds, or by braising.

Base 14 is sized and configured so as to provide adequate support to treadmill 10 when deck 12 is in the storage position. Base 14 also provides sufficient support while repositioning deck 12 from the operational position to the storage position when handrail 16 is automatically collapsing into substantial alignment with deck 12. Base 14 is sized to provide treadmill 10 with sufficient support so that deck 12 is stably supported in the storage position, in the operational position and during movement in between. Base 14 is also able to support handrail 16 as it moves simultaneously with deck 12.

Base 14 could be in any desired geometric shape with a predetermined length and width. The length and width are selected so that the distance between the vertical location of the center of gravity of treadmill 10 is such that the force necessary to tip treadmill 10 is necessarily more than that applied by an accidental bump or nudge. The distance base 14, including stabilizing members 68, extends outward away from wall 11 in the direction that deck 12 rotates when moving into the operational position, is selected such that tipping of treadmill 10 can be effected only by a user deliberately seeking to tip treadmill 10.

Similarly, the width of base 14 is selected so that the distance between the center of gravity and the perimeter of base 14 will resist accidental tipping by a bump or nudge. That is, treadmill 10 cannot be tipped sideways except by the application of a user deliberately seeking to tip treadmill 10 sideways.

As illustrated in FIG. 4, treadmill 10 also comprises a motor 98 that rotates a first pulley 101 that drives a belt 102. Belt 102 drives a second pulley 104 connected to rear roller 106 about which continuous belt 34 is disposed. The forward portion of continuous belt 34 also is disposed around a front roller 108. Rear roller 106 and front roller 108 are attached laterally between left frame member 22 and right frame member 24. Motor 98, pulleys 100, 104, and belt 102 are one embodiment of structure capable of performing the function of a drive means for supplying power to deck 12 to drive continuous belt 34. Other embodiments capable of performing the function of such drive means may include a flywheel. Various embodiments of drive means are equally effective in carrying out the intended function thereof.

As can be seen in FIG. 4, motor 98, pulleys 100, 104, and belt 102 are positioned within base 14 to the side of main body 15. The portion of base 14 that includes motor 98, pulleys 100, 104, and belt 102 is slightly raised in height when compared to main body 15. One advantage of having main body 15 separate from the drive means is that the height of the main body 15 can be reduced and is closer to the support surface. This makes it easier for the user to step on and off of main body 15 of base 14. Reducing the height of base 14 also reduces the necessary height of deck 12. As a result, the height of the exercise surface formed by endless belt 34 is reduced. The weight of the drive means acts as a counterbalance to stabilize treadmill 10 when deck 12 is being reoriented from the operational position shown in FIG. 1 to the storage position illustrated in FIG. 3.

An alternate embodiment of treadmill 10 includes deck 12 with drive means comprising a flywheel. Flywheel is connected to the continuous belt 34 and receives energy from the user operating the continuous belt 34 of deck 12. Flywheel also delivers energy to that continuous belt 34 as the user performs walking, running, or jogging exercises when the user is suspended and not in contact with continuous belt 34. In those embodiments of treadmill 10 that utilize a flywheel as a drive means rather than an electric motor, the operator may begin using treadmill 10 once deck 12 has been moved to the operational position.

Deck 12 has a longitudinal length which is selected to facilitate the performance of walking, jogging, or running exercises desired. The length may vary for treadmills configured for walking and treadmills configured for jogging and running. In addition, the length of the continuous belt 34 will vary correspondingly.

Figure 5:
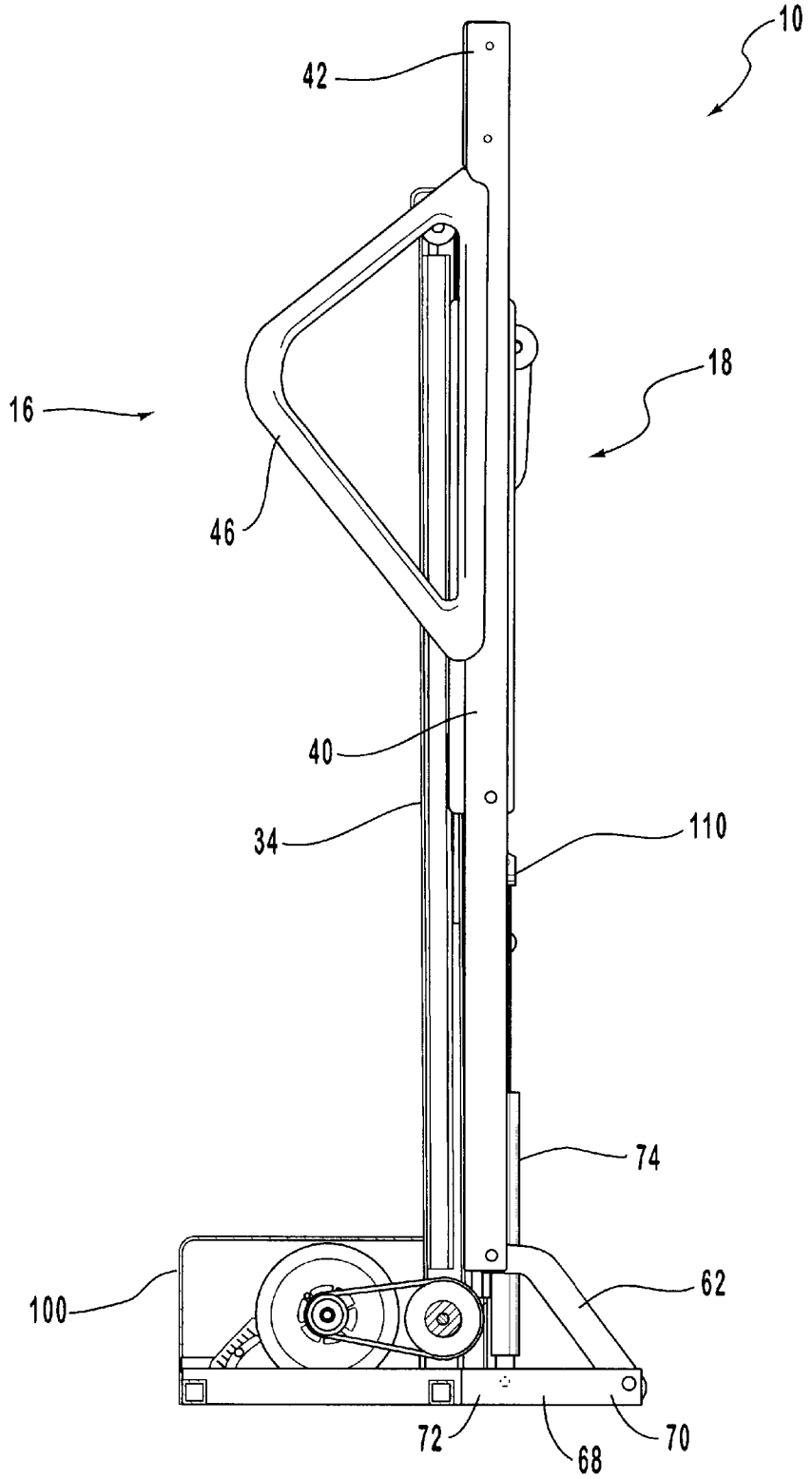
FIG. 5 is a partial cross-sectional elevation view of the treadmill shown in FIG. 3.

For some users, the amount of lifting force necessary to move deck 12 from the operational position to the storage position with handrail 16 automatically collapsing into substantial alignment with deck 12 may be large enough that rotating deck 12 is difficult. FIG. 3 illustrates one embodiment of treadmill 10 that incorporates a pneumatic cylinder 110. Pneumatic cylinder 110 is rotatably attached at one end to deck 12 and the opposite end thereof is attached to stabilizing member 68 of base 14. The embodiment of deck 12 illustrated in FIGS. 3 and 5 have pneumatic cylinder 110 attached to right frame member 22 of frame structure 18 and associated right side of base 14. Pneumatic cylinder 110 could instead be attached to the left frame member 20 of deck 12 and left side of base 14. Alternatively, a pneumatic cylinder 110 could mounted on both sides of deck 12. Pneumatic cylinder 110 is one example of structure capable of performing the function of lift assistance means for applying a force urging deck 12 to move from the operational position to the storage position. Other embodiments of structure capable of performing the function of a lift assistance means are equally effective in carrying out the intended function thereof.

It is also contemplated that handrail 16 may comprise moveable arms rotatably attached to the inside surface of uprights 40. For example, in one embodiment of handrail 16 moveable arms are pivotally attached to uprights 40 with a hand operated knob to tighten and secure moveable arms and to increase or decrease the resistance of the moveable arms to rotation. The moveable arms have a gripping portion configured for grasping by a user.

To use fold-out treadmill 10, a user rotates deck 12 from the storage position shown in FIG. 3 to the operational position as shown in FIG. 1. FIG. 4 shows the various interim positions as deck 12 moves from the operational position to the storage position. In the operational position, base 14, deck 12, and handrail 16 define a "footprint" of treadmill 10. It is intended that the "footprint" of treadmill 10 be regarded as the perimeter of the geometric figure of base 14, deck 12, and handrail 16 projected on to the support surface when tread base 12 is in the operational position. When deck 12 is moved from the storage position to the operational position, handrail 16 automatically moves into a position projecting above the front end 28 of deck 12. As deck 12 is moved between the operational position and the storage position, handrail 16 also moves. At all times during the movement of deck 12 between the operational position and storage position, both deck 12 and handrail 16 remain at all times within the "footprint" of treadmill 10. This enables treadmill 10 to be placed against a wall and remain there while deck 12 is moved between the operational and storage positions without either deck 12 or handrail 16 contacting the wall.

With deck 12 in the operational position, the user stands on continuous belt 34 and walks, jogs, or runs to perform exercises. If the user desires to vary the inclination, the user may, depending on the embodiment of treadmill 10, operate a switch on console 54 to electrically operate the automatic incline means or may manually adjust the incline means shown in FIG. 3 by rotating feet 92. The user may thereafter operate console 54 to energize the motor. In order to operate treadmill 10 utilizing an electric drive means, the user must provide energy to the system by inserting the plug into a conveniently available wall outlet.

Once the user is done exercising on treadmill 10, deck 12 is repositioned into the storage position by lifting front end 28 of deck 12, which causes handrail 16 to automatically collapse into substantial alignment with deck 12 when deck 12 is rotated into the storage position. Specifically, lifting front 28 of deck 12 causes elongated support 56 to rotate downward about the pivotal connection of lower end 60 toward deck 12. The rotational movement of elongated support 56 causes lower end 44 of upright 40 of handrail 16 that is attached to wheel 76 disposed in slider bracket 74 to translate linearly relative to deck 12. The linear translation of upright 40 causes distal end 66 of leg 62 to rotate, while proximal end 64 of leg 62 that is attached to lower end 44 of upright 40 rotates. The rotational movement of the various structural parts as well as the linear translation of handrail 16 relative to deck 12 happens substantially simultaneously while deck 12 is being lifted at front end 28 thereof. The rotational movement and the linear translation of handrail 16 automatically occurs every time deck 12 is repositioning between the operational position and the storage position. In addition, the rotational movement and the linear translation of handrail 16 keeps handrail 16 within the "footprint" of treadmill 10.

Although not shown in the figures, it is contemplated that treadmill 10 may also include a latching means for retaining deck 10 in the storage position with handrail 16 collapsed into substantial alignment with deck 12. Those skilled in the art will recognize that various forms and shapes of latching mechanism may be used to facilitate the automatic latching arrangement.

Figure 6:
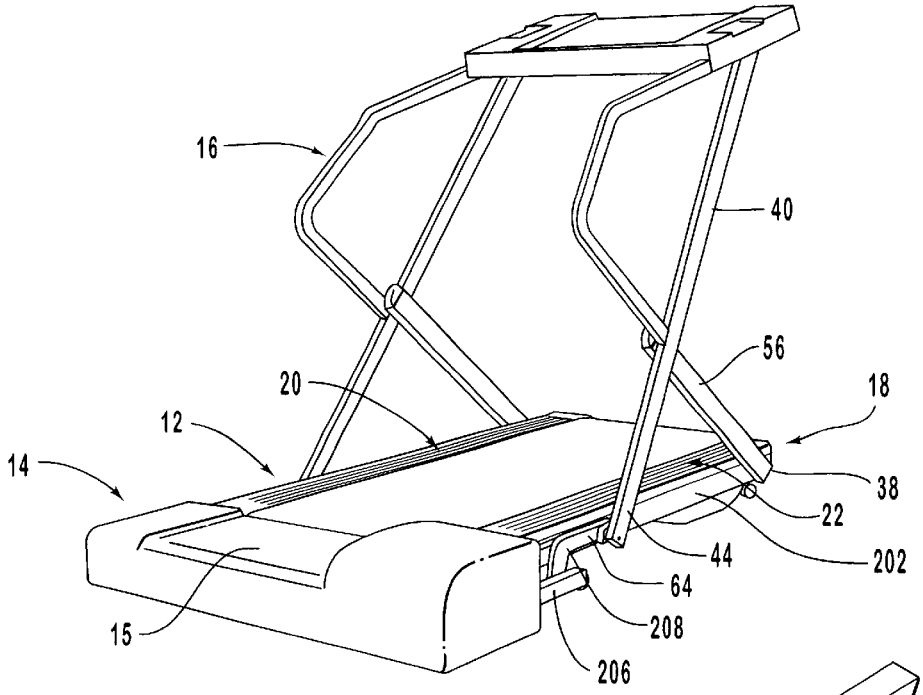
FIG. 6 is a perspective view of another embodiment of the fold-out treadmill in the operational position.

FIG. 6 illustrates another embodiment of a fold-out treadmill 200. The majority of the features previously discussed apply to this embodiment of treadmill 200. The features that are not effected are identified with the same reference numbers as used in FIGS. 1–5. Only those features that have changed will be described in detail.

FIG. 6 depicts another embodiment of treadmill 200 that includes another embodiment of a fold-out assembly. As previously discussed, deck 12 comprises a frame structure 18 that includes a left frame member 20 and a right frame member 22 which are mirror images of each other. In one embodiment of treadmill 200, left frame member 20 and right frame member 22 comprise a side rail 202 and a side base 38. As more clearly shown in FIG. 7, side rail 202 has an elongated aperture 204 formed therethrough.

Treadmill 200, shown in FIG. 6, comprises base 14. In the embodiment illustrated, base 14 includes main body 15 and a pair of stabilizer members 206. As more clearly depicted in FIG. 8, stabilizer members 206 have a forward end 70 and a back end (not shown). In one embodiment, forward end 70 of stabilizer members 206 has a wheel 216 attached thereto. Wheel 216 assists the user in moving treadmill 200 when deck 12 is in the storage position generally depicted in FIGS. 3 and 5.

Figure 7:
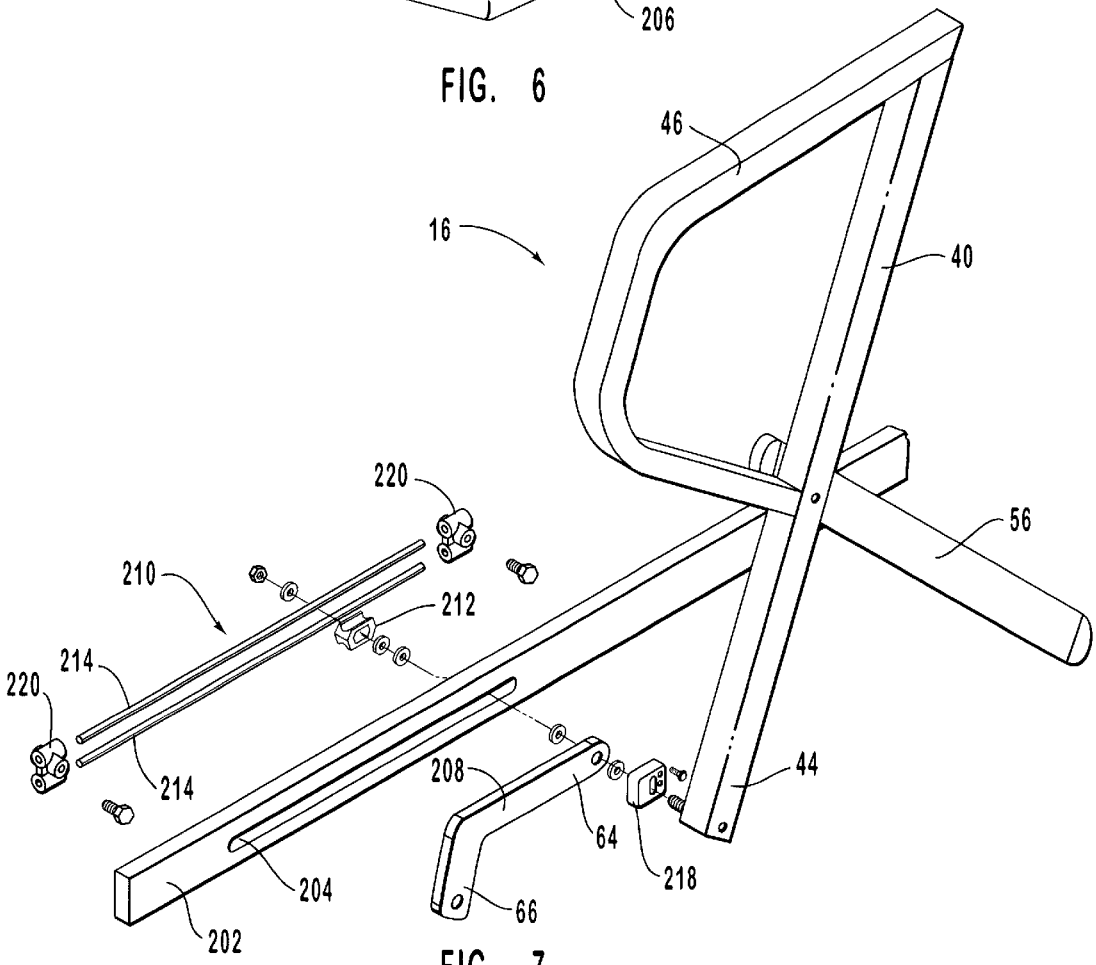
FIG. 7 is a partial exploded perspective view of the fold-out structure of the treadmill of FIG. 6.
Figure 8:
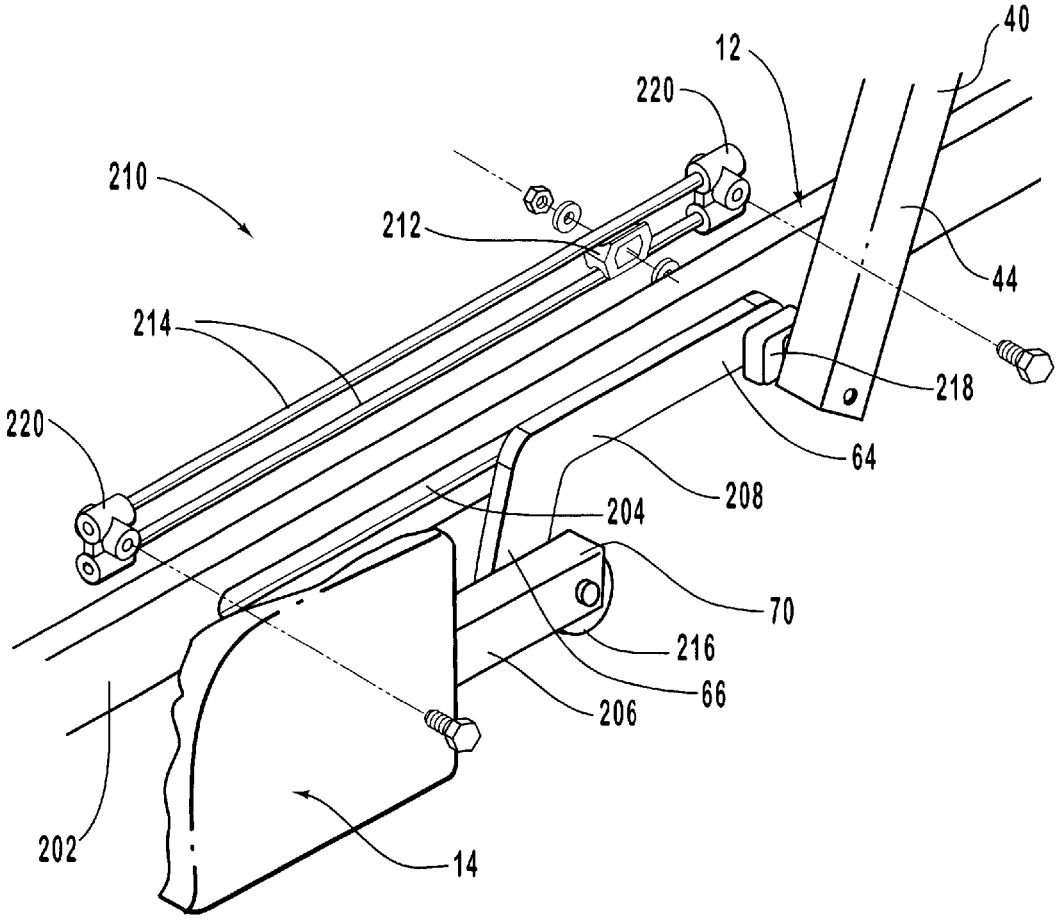
FIG. 8 is a partial exploded view of the structure of FIG. 7.

Treadmill 200 also includes handrail 16 shown in FIGS. 6 and 7. Lower end 44 of upright 40 of handrail 16 is movably attached to a leg 208. As shown in FIG. 7, leg 208 has a proximal end 64 and a distal end 66. Referring now to FIG. 8, proximal end 64 of leg 208 is movably attached to lower end 44 of upright 40. The distal end 66 of leg 208 is movably attached to stabilizer member 206. In one embodiment, distal end 66 of leg 208 is pivotally attached to stabilizer member 206. As illustrated, treadmill 200 includes and an optional spacer member 218 disposed between proximal end 64 of leg 208 and lower end 44 of upright 40.

Referring to FIG. 7, in one embodiment, a fold-out assembly comprises an elongated slider assembly 210 attached to the interior of side rail 202, aperture 204 formed in side rail 202, leg 208, and support member 56. One embodiment of slider assembly 210 comprises a slider 212 and a pair of slider rods 214. As illustrated, one embodiment of slider rods 214 has a substantially round cross-section. It will be appreciated, however, that slider rods 214 may have various other cross-sectional configurations, such as by way of example and not limitation, oval, elliptical, square, rectangular, and the like, or any combination thereof.

Turning to FIG. 8, a rod housing 220 is mounted on each end of slider rods 214. In one embodiment, rod housing 220 is configured to receive a portion of slider rod 214 therein and to hold them in a substantially parallel relationship. Slider 212 is disposed between slider rods 214. The outside surface of slider 212 is configured to cooperate with the configurations of slider rods 214. In an alternate embodiment, slider assembly 210 comprises one (1) slider rod and a slider that is configured to be mounted on the slider rod. In this embodiment, the slider has an opening formed therein that is configured to receive the slider rod therein for linear movement. It will be appreciated that various other configurations and arrangements of a slider assembly may be utilized.

As previously mentioned the lower end 44 of upright 40 is pivotally attached to proximal end 64 of leg 208. Lower end 44 of upright 40 and proximal end 64 of leg 204 are slidingly attached to slider assembly 210 through aperture 208 formed in side rail 202. More particularly, lower end 44 of upright 40 and proximal end 64 of leg 208 are attached to slider 212 through aperture 204. Slider 212 is disposed between slider rods 214 so as to allow linear translation of lower end 44 of upright 40 of handrail 16 relative to deck 12 by, for example and not limitation, a bolt, rod, screw, or the like. Other methods of movably attaching lower end 44 of upright 40 and proximal end 64 of leg 208 to slider 212 through aperture 204 in side rail 202 are equally effective in carrying out the intended function thereof. Slider rods 214, slider 212 and aperture 204 in side rail 202 depicted in FIGS. 7 and 8 are one embodiment of structure capable of preforming the function of a slider means for allowing linear translation of handrail 16 relative to deck 12.

Elongated supports 56, legs 208, and slider means are one embodiment of structure capable of performing the function of a fold-out means for connecting handrail 16 to deck 12 so as to enable handrail 16 to project above deck 12 when deck 12 is in the operational position and to automatically collapse substantially into alignment with deck 12 when deck 12 is rotated into the storage position. As with the embodiment of fold-out means illustrated in FIGS. 2A and 2B, the embodiment of fold-out means depicted in FIGS. 7 and 8 allows deck 12 to be repositioned by pivotal movement between the operational position and the storage position while substantially simultaneously handrail 16 pivots and linearly translates in response to the movement by deck 12.

In use, fold-out treadmill 200 operates very similarly as treadmill 10. In the operational position, base 14, deck 12, and handrail 16 define a "footprint" of treadmill 200. When deck 12 is moved from the storage position to the operational position, handrail 16 automatically moves into a position projecting above the front end 28 of deck 12. As deck 12 is moved between the operational position and the storage position, handrail 16 also moves. During the movement of deck 12 between the operational position and storage position, both deck 12 and handrail 16 remain at all times within the "footprint" of treadmill 10.

Once the user is done exercising on treadmill 10, deck 12 is repositioned into the storage position by lifting front end 28 of deck 12, which causes handrail 16 to automatically collapse into substantial alignment with deck 12 when deck 12 is rotated into the storage position. Specifically, lifting front 28 of deck 12 causes elongated support 56 to rotate downward about the pivotal connection of lower end 60 toward deck 12. The rotational movement of elongated support 56 causes lower end 44 of upright 40 of handrail 16 that is attached through aperture 204 to slider 212 of slider assembly 210 to translate linearly relative to deck 12. The linear translation of upright 40 causes distal end 66 of leg 208 to rotate, while proximal end 64 of leg 208 that is attached to lower end 44 of upright 40 rotates. The rotational movement of the various structural parts as well as the linear translation of handrail 16 relative to deck 12 happens substantially simultaneously while deck 12 is being lifted at front end 28 thereof.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A fold-out treadmill comprising:

(a) a base having a rear end and an opposing front end;

(b) a deck having a rear end, an opposing front end and an endless belt rotatably mounted thereon, said rear end of said deck being movably attached to said base;

(c) a handrail movably attached to said deck;

(d) said deck configured to be selectively rotated between an operational position in which said deck is positioned for use by a user positioned thereon, and a substantially vertical storage position in which said front end of said deck is positioned proximate to said handrail; and (e) said handrail further being configured to fold into a compact storage configuration when said deck is moved from said operational position to said storage position and to unfold when said deck is moved from said storage position to said operational position such that said handrail extends above said front end of said deck when said deck is in said operational position, said handrail further being configured such that while said deck is being moved between said operational position and said storage position said handrail does not extend beyond said rear end of said base.

2. A fold-out treadmill as recited in claim 1, wherein said deck, said base, and said handrail define a footprint on a support surface when said deck is in said operational position and wherein said handrail and said deck remain entirely within said footprint as said deck is moved between said operational position and said storage position.

3. A fold-out treadmill as recited in claim 1, further comprising a fold-out means for attaching said handrail to said deck so as to enable said handrail to project above said deck when said deck is in said operational position and to collapse into said compact storage configuration when said deck is rotated into said storage position.

4. A fold-out treadmill as recited in claim 3, wherein said fold-out means comprises a fold-out assembly configured to movably connect said handrail to said deck so as to enable said handrail to project above said deck when said deck is in said operational position and to collapse into said compact storage configuration when said deck is rotated into said storage position.

5. A fold-out treadmill as recited in claim 4, wherein said fold-out assembly is configured such that said handrail is repositioned by pivotal movement as said deck is selectively repositioned from said storage position into said operational position.

6. A fold-out treadmill as recited in claim 1, further comprising an incline assembly attached to said deck, said incline assembly being configured to vary the inclination of said deck relative to a support surface while said deck is in said operational position.

7. A fold-out treadmill as recited in claim 1, further comprising a lift assistance assembly attached to said deck, said lift assistance assembly being configured to urge said deck to move from said operational position to said storage position.

8. A fold-out treadmill as recited in claim 7, wherein said lift assistance assembly comprises a pneumatic cylinder.

9. A fold-out fold-out treadmill comprising:

(a) a handrail having a rear end and a front end;

(b) a support structure comprising:

(i) a base having a rear end and an opposing front end; and (ii) a deck having a front end, a rear end, and an endless belt rotatably mounted thereon, said rear end of said deck being moveably attached to said base so as to enable said deck to selectively rotate between an operational position in which said deck is positioned for operation by a user positioned thereon and a substantially vertical storage position in which said front end of said deck is positioned proximate to said handrail;

(c) fold-out means for connecting said rear end of said handrail to said support structure so as to enable said front end of said handrail to project above said front end of said deck when said deck is in said operational position and to automatically collapse into a compact storage configuration when said deck is in said storage position; and (d) said handrail further being configured such that when said deck is moved between said operational position and said storage position said handrail does not extend beyond said rear end of said base.

10. A fold-out treadmill as recited in claim 9, wherein said fold-out means is configured such that said handrail is repositioned as said deck is selectively rotated from said storage position into said operational position.

11. A fold-out treadmill as recited in claim 10, wherein said fold-out means comprises:

(a) a leg having a proximal end rotatably attached to said rear end of said handrail and a distal end rotatably attached to said base, said proximal end of said leg and said rear end of said handrail being movably connected to said deck to allow said handrail to automatically collapse into a compact storage configuration when said deck is rotated from said operational position into said storage position; and (b) slider means for allowing linear translation of said handrail relative to said deck.

12. A fold-out treadmill as recited in claim 9, wherein said base is capable of stably supporting the treadmill when said deck is in either said operational position or said storage position and when said deck is being repositioned therebetween.

13. A fold-out treadmill as recited in claim 12, wherein said base comprises a body and a stabilizer member attached thereto.

14. A fold-out treadmill as recited in claim 9, further comprising a pneumatic cylinder rotatably attached at one end thereof to said deck and the opposite end of the pneumatic cylinder being rotatably attached to said base.

15. A fold-out treadmill as recited in claim 9, wherein said handrail comprises:

(a) a pair of uprights movably connected to said deck, said pair of uprights being configured to project above said deck when said deck is in said operational position and to automatically collapse into substantial alignment with said deck when said deck is rotated into said storage position; and (b) a pair of handles attached to said uprights.

16. A fold-out treadmill comprising:

(a) a handrail having a rear end and front end;

(b) a support structure comprising:

(i) a base having a rear and an opposing front end; and (ii) a deck having a front end, a rear end, and an endless belt rotatably mounted thereon, said rear end of said deck being moveably attached to said base so as to enable said deck to selectively rotate between an operational position in which said deck is positioned for operation by a user positioned thereon and a substantially vertical storage position in which said front end of said deck is positioned proximate to said handrail;

(c) a fold-out assembly for connecting said rear end of said handrail to said support structure so as to enable said front end of said handrail to project above said front end of said deck when said deck is in said operational position and to automatically collapse into a compact storage configuration when said deck is in said storage position; and (d) said handrail further being configured such that when said deck is moved between said operational position and said storage position said handrail does not extend beyond said rear end of said base.

17. A fold-out treadmill as recited in claim 16, wherein said fold-out assembly is configured such that said handrail is repositioned by a combination of pivotal movement and linear translation relative to said deck as said deck is selectively rotated from said storage position into said operational position.

18. A fold-out treadmill as recited in claim 16, wherein said fold-out assembly comprises:

(a) a leg having a proximal end rotatably attached to said rear end of said handrail and a distal end rotatably attached to said base, said proximal end of said leg and said rear end of said handrail being moveably attached to said deck to allow said handrail to automatically collapse into a compact storage configuration when said deck is rotated from said operational position into said storage position by a combination of rotational movement and linear translation relative to said deck; and (b) a slider assembly connected to the rear end of said handrail, said slider assembly being configured to allow linear translation of said handrail relative to said deck when said deck is selectively rotated between said storage position and said operational position.

19. A fold-out treadmill as recited in claim 18, wherein said slider assembly comprises:

(a) an elongated bracket attached to said deck; and (b) a slider attached to the rear end of said handrail, said slider being disposed in said elongated bracket allowing the second end of said handrail to translate linearly relative to said deck so as to make said handrail automatically collapse into a compact storage configuration when said deck is rotated into said storage position.

20. A fold-out treadmill as recited in claim 18, wherein said slider assembly comprises:

(a) a slider rod attached to said deck; and (b) a slider connected to said rear end of said handrail, said slider being configured to cooperate with said slider rod so as to allow said handrail to translate linearly relative to said deck and so as to make said handrail automatically collapse into a compact configuration when said deck is rotated into said storage position.

21. A fold-out treadmill comprising:

(a) a base having a rear end and an opposing front end, said base configured to rest upon a support surface;

(b) a handrail having a rear end and a front end;

(c) a deck having a front end, a rear end, and an endless belt rotatably mounted thereon, said rear end of said deck being rotatably mounted to said base so as to enable said deck to selectively rotate between an operational position in which said deck is positioned for operation by a user positioned thereon, and a substantially vertical storage position in which said deck is rotated such that said front end of said deck is positioned proximate to said handrail;

(d) a fold-out assembly moveably connecting said rear end of said handrail to said deck so as to enable the front end of said handrail to project above the front end of said deck when said deck is in said operational position and to automatically collapse into a compact storage configuration when said deck is rotated into said storage position, said fold-out assembly further being configured such that said handrail is repositioned by a combination of pivotal movement and linear translation relative to said deck as said deck is selectively repositioned by pivotal movement from said storage position into said operational position; and (e) said handrail further being configured such that when said deck is moved between said operational position and said storage position said handrail does not extend beyond said rear end of said base.

22. A fold-out treadmill as recited in claim 21, wherein said fold-out assembly comprises:

(a) an elongated support having an upper end rotatably attached to said handrail and a lower end rotatably attached to said deck;

(b) a leg having a proximal end attached to the rear end of said handrail and a distal end rotatably attached to said base, said distal end of said leg allowing said handrail to rotate relative to said deck while automatically collapsing into a compact storage configuration when said deck is rotated form said operational position into said storage position; and (c) a slider assembly configured to allow linear translation of said handrail relative to said deck, said slider assembly being attached to the rear end of said handrail.

23. A fold-out treadmill as recited in claim 22, wherein said slider assembly comprises:

(a) an elongated slot formed in the side of said deck;

(b) a plurality of slider rods attached to the interior surface of said deck; and (c) a slider connected to said rear end of said handrail, said slider being configured to cooperate with said plurality of slider rods to allow said handrail to translate linearly relative to said deck so as to make said handrail automatically collapse into a compact configuration when said deck is rotated into said storage position.

* * * * *

UNITED STATES PATENT AND TRADEMARK OFFICE

CERTIFICATE OF CORRECTION

PATENT NO. : 6,350,218 B1
APPLICATION NO. : 09/470605
DATED : February 26, 2002
INVENTOR(S) : Dalebout et al.

It is certified that error appears in the above-identified patent and that said Letters Patent is hereby corrected as shown below:

Title page,
Item (56), under "Foreign Patent Documents" add --GB 2 120 560 12/1983--
Item (56), under "Other Publications" add the following publications:
--Cover and selected pages from the Taiwan Buyer's Guide- 1993
Cover Page, page 2 and 81 from Brochure Entitled "Taiwan Sports Goods" (Buyer's Guide '95)
The Battle Creek Health Walker Catalog - 1958
Owner's Manual for Cross Walk Advantage - 1994--

Column 1,
Line 42, after "used" insert --to--

Column 4,
Line 2, before "depict" change "drawing" to --drawings--
Line 39, after "handrail 16" insert a period Column 5,
Line 49, after "left frame" delete the comma Column 8,
Line 22, after "both" change "lacing" to --facing--

Column 10,
Line 60, after "could" insert --be--

Column 12,
Line 39, before "an optional" delete "and"

UNITED STATES PATENT AND TRADEMARK OFFICE

CERTIFICATE OF CORRECTION

PATENT NO. : 6,350,218 B1
APPLICATION NO. : 09/470605
DATED : February 26, 2002
INVENTOR(S) : Dalebout et al.

It is certified that error appears in the above-identified patent and that said Letters Patent is hereby corrected as shown below:

Column 18,
Line 6, after "rotated" change "form" to --from--

Signed and Sealed this

Eleventh Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 6,350,218 B1
APPLICATION NO. : 09/470605
DATED : February 26, 2002
INVENTOR(S) : Dalebout et al.

It is certified that error appears in the above-identified patent and that said Letters Patent is hereby corrected as shown below:

Column 1

Line 33, change "cause" to --causes--

Signed and Sealed this

Fifteenth Day of January, 2008

JON W. DUDAS
*Director of the United States Patent and Trademark Office*